United States Patent [19]

Zicko

[11] 4,171,745

[45] Oct. 23, 1979

[54] PROTECTIVE INSERT

[75] Inventor: James A. Zicko, Natick, Mass.

[73] Assignee: Container Corporation of America, Chicago, Ill.

[21] Appl. No.: 935,145

[22] Filed: Aug. 21, 1978

[51] Int. Cl.[2] ..... B65D 81/02

[52] U.S. Cl. ..... 206/594; 220/410; 229/15

[58] Field of Search ..... 206/521, 591, 592, 593, 206/594; 229/42, 15; 220/400, 408, 410

[56] References Cited

U.S. PATENT DOCUMENTS

| | | | |
|---|---|---|---|
| 2,160,816 | 6/1939 | Barnes | 206/591 |
| 2,176,274 | 10/1939 | Parnin | 206/592 |
| 2,827,219 | 3/1958 | Sparks | 206/592 |
| 3,279,677 | 10/1966 | Wojcik | 206/594 |
| 3,587,838 | 6/1971 | Miyata | 206/592 |

*Primary Examiner*—Stephen P. Garbe

*Attorney, Agent, or Firm*—Carpenter & Ostis

[57] ABSTRACT

A package insert formed of a one piece sheet of paperboard for isolating and protecting a fragile article within an outer package.

1 Claim, 4 Drawing Figures

PROTECTIVE INSERT

SUMMARY OF THE INVENTION

This invention relates to packaging and particularly to a paperboard insert for use within an outer package. The insert is designed to provide air cells between the walls of the insert and walls of the outer package to isolate and cushion a fragile packaged article.

It is an object of the invention to provide, in a protective insert of the type described, a structure of simple design and construction which is formed from a unitary blank of paperboard and which, when folded, provides cushioning air cells between the sides of the insert and the outer package.

This and other objects of the invention will be apparent from an examination of the following description and drawings.

THE DRAWINGS

It will be understood that, for purposes of clarity, certain elements may have been intentionally omitted from certain views where they are believed to be illustrated to better advantage in other views.

THE DESCRIPTION

Figure 4:
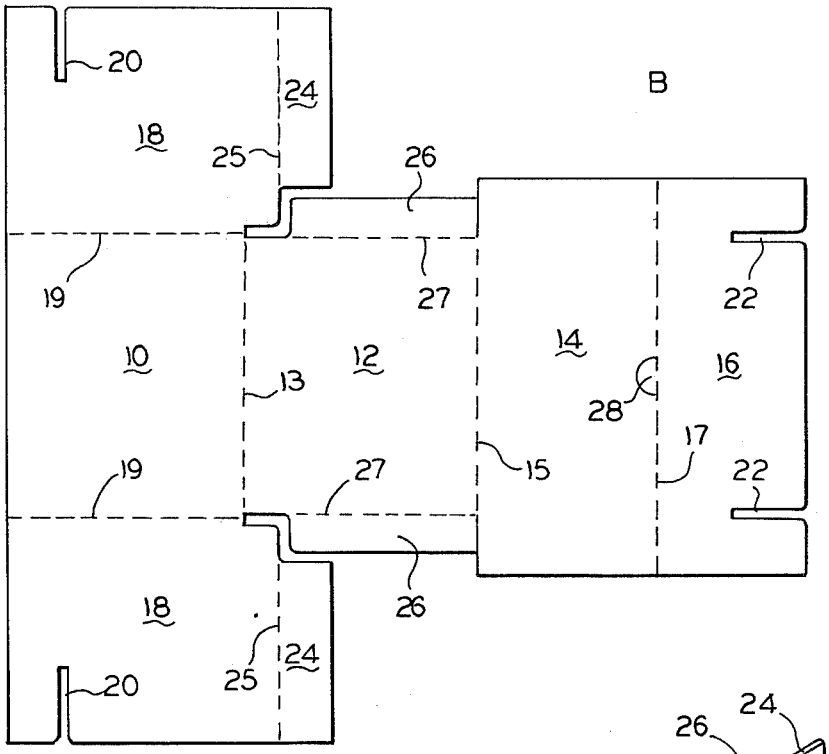
FIG. 4 is a plan view of a blank of foldable sheet material from which the structure illustrated in the other views may be formed.
Figure 2:
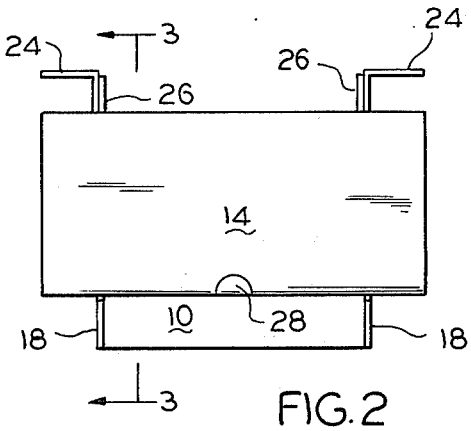
FIG. 2 is a top plan view of the structure erected in FIG. 1.
Figure 1:
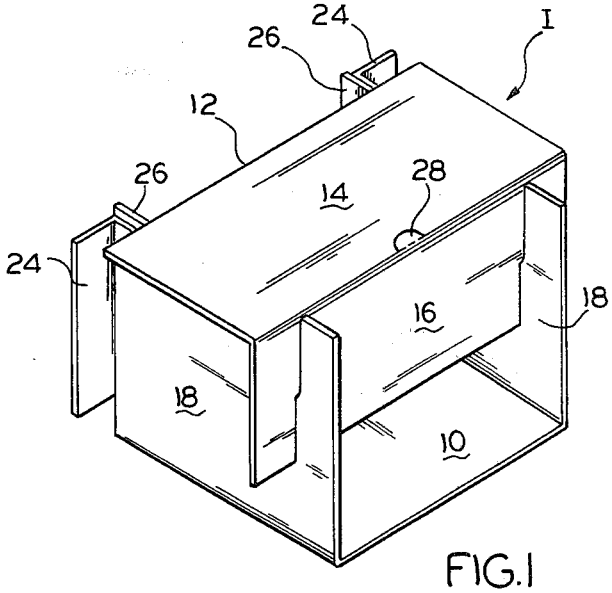
FIG. 1 is a perspective view of a protective packaging insert as seen in the fully assembled and erected condition.
Figure 3:
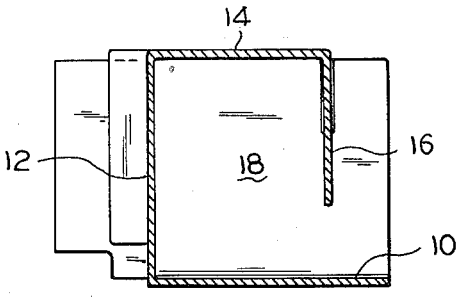
FIG. 3 is a fragmentary, vertical section taken on line 3—3 of FIG. 2.

Referring now to the drawings for a better understanding of the invention, it will be seen that a protective packaging insert, indicated generally at I in FIG. 1 of the drawings, may be formed from a unitary blank B of foldable sheet material, such as paperboard, illustrated in FIG. 4.

As best seen in FIG. 1, insert I includes a preferably rectangular, horizontal bottom wall or base 10; a rear wall 12 foldably joined at its lower edge along fold line 13 to the rear edge of bottom wall 10; a horizontal top wall 14 foldably joined at its rear edge along fold line 15 to an upper edge of rear wall 12; a front wall 16 foldably joined at its upper edge along fold line 17 to a forward edge of top wall 14, and a pair of side walls 18 foldably joined at their lower edges along fold lines 19 to opposed side edges of bottom wall 10.

Each of the side walls 18 is provided with a slot 20 extending downwardly from the upper edge of side wall and spaced inwardly from the forward edge thereof, which is adapted to cooperate with a mating slot 22 formed in the lower edge of front wall 16 and spaced inwardly from the end edge thereof to provide interlocking relationship between the front wall and side walls, It will be noted that the rear portions of side walls 18 extend rearwardly of rear wall 12 so as to lie in face-to-face relation with rearwardly extending flaps 26 which are foldably joined along fold lines 27 to opposed side edges of rear wall 12. Additionally, side walls 18 are provided with flaps 24 which are foldably joined at their inner edges along fold lines 25 to the rear edges of side walls 18 and which are folded outwardly at right angles to the side walls in parallel relation with the front and rear walls 14 and 12, respectively.

Thus it will be appreciated that the forward and rear extensions of the side walls, the side wall flaps, and the side extensions of the top and front walls all project outwardly from the body of the insert to provide air or cushioning cells between the body of the insert and the inner walls of an outer wrapper or container not shown. These air cells serve to cushion the packaged article which is isolated from the outer container within the insert I.

If desired, a finger opening 28 may be provided adjacent the forward edge of top wall 14.

Thus it will be appreciated that the invention provides a simple but rugged packaging insert of simple design and construction which is formed from a one-piece blank of paperboard with portions connected in interlocking relationship, without the necessity of outside securing means such as glue or staples.

I claim:

1. A packaging insert, formed from a single unitary blank of foldable paperboard, for holding a packaged article in spaced relation to the walls of an outer container or wrapper, comprising:

(a) a bottom wall;

(b) a rear wall and opposed side walls foldably joined to and upstanding from rear and side edges of said bottom wall;

(c) a top wall foldably joined at its rear edge to and extending forwardly from an upper edge of said rear wall;

(d) a front wall foldably joined to and depending from a forward edge of said top wall;

(e) said front wall having interlocking enegagement with said side walls;

(f) said rear wall having a pair of flaps hinged to the respective side edges thereof and folded normal to and extending rearwardly from said rear wall;

(g) said top and front walls including portions projecting outwardly beyond said side walls, and said side walls including portions projecting outwardly beyond said front and rear walls to provide with said flaps cushioning cells adjacent said walls of said insert.

* * * * *